US009366469B2

(12) United States Patent
Chapman, Jr.

(10) Patent No.: US 9,366,469 B2
(45) Date of Patent: Jun. 14, 2016

(54) TEMPERATURE CONTROLLED BOX SYSTEM

(71) Applicant: EFP LLC, Elkhart, IN (US)

(72) Inventor: Learmond A. Chapman, Jr., Nashville, TN (US)

(73) Assignee: EFP LLC, Elkhart, IN (US)

( * ) Notice: Subject to any disclaimer, the term of this patent is extended or adjusted under 35 U.S.C. 154(b) by 583 days.

(21) Appl. No.: 13/843,334

(22) Filed: Mar. 15, 2013

(65) Prior Publication Data

US 2013/0291584 A1 Nov. 7, 2013

Related U.S. Application Data

(60) Provisional application No. 61/687,945, filed on May 3, 2012.

(51) Int. Cl.
*F25D 3/08* (2006.01)

(52) U.S. Cl.
CPC ..... *F25D 3/08* (2013.01); *F25D 2303/082* (2013.01); *F25D 2303/0843* (2013.01); *F25D 2303/0844* (2013.01); *F25D 2303/0845* (2013.01); *F25D 2331/804* (2013.01)

(58) Field of Classification Search
CPC ..... B65D 81/38; B65D 81/3825; B65D 81/3834; B65D 81/3848; B65D 81/3862; F25D 3/02; F25D 3/06; F25D 3/08; F25D 3/10; F25D 3/102; F25D 3/105; F25D 3/107
See application file for complete search history.

(56) References Cited

U.S. PATENT DOCUMENTS

| | | | | |
|---|---|---|---|---|
| 1,930,680 | A | 10/1933 | Hinton | |
| 3,236,206 | A | 2/1966 | Willinger | |
| 4,862,674 | A | 9/1989 | Lejondahl et al. | |
| 5,419,152 | A * | 5/1995 | Silber | 62/372 |
| 5,560,486 | A * | 10/1996 | Zak | 206/423 |
| 5,669,233 | A * | 9/1997 | Cook et al. | 62/371 |
| 6,325,281 | B1 | 12/2001 | Grogan | |
| 7,257,963 | B2 | 8/2007 | Mayer | |
| 7,849,708 | B2 | 12/2010 | Goncharko et al. | |
| 7,908,870 | B2 * | 3/2011 | Williams et al. | 62/62 |
| 8,074,465 | B2 | 12/2011 | Heroux | |
| 8,424,335 | B2 | 4/2013 | Corder | |
| 8,651,593 | B2 * | 2/2014 | Bezich et al. | 312/259 |
| 2002/0139834 | A1 * | 10/2002 | Becker | 229/103.11 |
| 2005/0150244 | A1 * | 7/2005 | Hillmann et al. | 62/371 |
| 2005/0224501 | A1 * | 10/2005 | Folkert et al. | 220/592.2 |
| 2010/0258574 | A1 * | 10/2010 | Bentley | 220/592.2 |
| 2012/0279896 | A1 * | 11/2012 | Lantz | 206/584 |
| 2012/0305435 | A1 | 12/2012 | Matta | |

FOREIGN PATENT DOCUMENTS

| | | | |
|---|---|---|---|
| EP | 2374443 A1 * | 10/2011 | F25D 3/06 |
| JP | 2007246097 | 9/2007 | |

* cited by examiner

*Primary Examiner* — Cassey D Bauer
*Assistant Examiner* — Antonio R Febles
(74) *Attorney, Agent, or Firm* — Shane V. Cortesi

(57) ABSTRACT

A box system for keeping medicine and other payloads at a desired temperature for prolonged periods of time is described. The system generally includes three or more insulating materials between a refrigerant and the payload. A box having foldable tabs for securing the materials to each other is also disclosed herein.

25 Claims, 10 Drawing Sheets

TEMPERATURE CONTROLLED BOX SYSTEM

CROSS-REFERENCES TO RELATED APPLICATIONS

This application claims the benefit of U.S. Provisional Application No. 61/687,945, titled Improved Temperature Control for Shipping Containers Using Biased Ballast System, filed May 3, 2012, the contents of which are hereby incorporated by reference in their entirety.

TECHNICAL FIELD

The present invention relates to temperature-controlled boxes for shipping medicines and other payloads.

BACKGROUND OF THE INVENTION

Many pharmaceutical manufacturers recommend that their medicines be kept at a temperature of between 2° C. and 8° C. at all times. Thus, various box systems have been developed to keep medicinal payloads at this temperature range during shipment.

Such prior art systems generally rely on an expensive phase change material to achieve the desired temperature range. For example, commonly, deuterium oxide (heavy water), which has a melting point of about 4 degrees Celsius, or decanol-1, which has a melting point of about 6.4 degrees Celsius, are used as phase change materials in shipping boxes to keep medicines at this temperature range during shipment. However, deuterium oxide and decanol-1 are very expensive.

U.S. Pat. No. 7,257,963 ("the '963 patent") teaches a system for shipping articles under controlled temperature conditions. As illustrated in FIGS. 3 and 4, the system includes an outside container 100 such as corrugated cardboard. A series of sytrofoam insulated panels 149 line the inside walls of the outside container 100. A plurality of chambers 250 containing ice/water are seated inside the insulated panels 149 and hold the interior temperature at 0° C. for so long as it takes to melt and/or freeze the water/ice mixture. A second series of sytrofoam insulated panels 249 are positioned adjacent the interior walls of the chambers 250. Finally, a second phase change material 300, deuterium oxide, is placed inside the second series of insulated panels 249 to create a retention chamber. The payload is placed in the retention chamber. The system described in the '963 patent, however, suffers from at least one very important disadvantage: it is very expensive. According to the '963 patent, the system described therein requires $100 in deuterium oxide alone.

U.S. Pat. No. 7,849,708 ("the '708 patent") describes a shipping system that uses 0.5 pounds of decanol-1. However, decanol-1 is very expensive. In addition, the systems described in the '708 patent are only for local one-day delivery and are not designed to keep the payload at the desired temperature range beyond a one-day period.

Thus, there is need for shipping systems that are effective in creating a temperature-controlled environment for payloads such as medicines (e.g., pharmaceuticals and biologics) that keep such medicines at a desired range for a prolonged period of time and can be produced and sold at a fraction of the price of the systems currently on the market.

BRIEF SUMMARY

The present invention relates to a box system for keeping medicine and other payloads at a desired temperature for prolonged periods of time. The system generally includes three or more insulating materials between a refrigerant and the payload so that the payload is not cold-shocked by the refrigerant but maintains a desired temperature range during shipment. An advantage of the box system of certain embodiments of the present disclosure is that the system allows a shipper to use a temperature controlled system that is effective in controlling temperature without the need for any expensive phase change materials.

In some embodiments, the box system includes a first outer box having an exterior and an interior; a refrigerant disposed in the first outer box interior; a container comprising an interior and an exterior, the container disposed interior to the refrigerant within the first outer box; a payload disposed in the container interior; a first insulating material disposed between the refrigerant and the container; a second insulating material disposed between the first insulating material and the container; and a third insulating material disposed between the second insulating material and the container, wherein the second insulating material is different from the first insulating material and the third insulating material. The first insulating material forms a first barrier between the refrigerant and the container. The second insulating material forms a second barrier between the refrigerant and the container, is disposed between the first barrier and the container and optionally substantially lines the first barrier. The third insulating material forms a third barrier between the refrigerant and the container, is disposed between the second barrier and the container and optionally substantially lines the first barrier. Optionally, the box system further includes a fourth insulating material disposed between the third insulating material and the container.

Optionally, the refrigerant is a water-based refrigerant, such as ice, the payload is a medicine having a temperature between about 2 degrees and about 8 degrees Celsius, and the box system is configured to maintain the medicine at a temperature of between about 2 degrees and about 8 degrees Celsius for at least about 72 hours, more preferably at least about 120 hours. In some embodiments, the box system is configured to maintain the medicine at a temperature of between about 2 degrees and about 8 degrees Celsius for up to about 144 hours. Optionally, the first, second third, and fourth (if included) insulating material each are an insulant selected from the group consisting of liquid water, corrugated cardboard, polyurethane, polyethylene, expanded polyethylene, expanded polypropylene, polypropylene, expanded polystyrene, extruded polystyrene, and corrugated plastic.

Preferably, the first outer box interior contains no more than about 0.25 pounds (i.e., 0 to about 0.25 pounds, more preferably 0 to about 0.1 pounds) of a phase change material having a melting point between about 2 degrees Celsius and about 8 degrees Celsius. Optionally, the first outer box interior does not have an electrically-powered temperature control device and the box system is configured to retain the desired temperature range without electricity. Optionally, the box system further includes a second outer box, and the second outer box has an interior and an exterior, and the first outer box is located in the second outer box interior. Optionally, the first outer box is made of expanded polystyrene. Optionally, the box system has substantially no refrigerant adjacent to the payload container.

The present disclosure also provides an inner box for use in the box system and the inner box may form the third barrier. The inner box is generally rectangular in shape and has an open top, a bottom, and four sides, each of which has a top, a bottom, and a height extending from the top of the side to the bottom of the side, and the tops of the sides each have a generally rectangular tab extending therefrom. The tabs may have a first foldline, located at the intersection of the top sides and the tabs, along which the tabs are configured to fold horizontally relative to the tops, and the tabs include a second foldline along which the tabs are configured to fold vertically relative to the tops. Optionally, the tabs are configured such that when the tabs are folded horizontally along the first foldline and vertically along the second foldline, the tabs do not extend to the bottoms of the sides.

DETAILED DESCRIPTION

Figure 1:
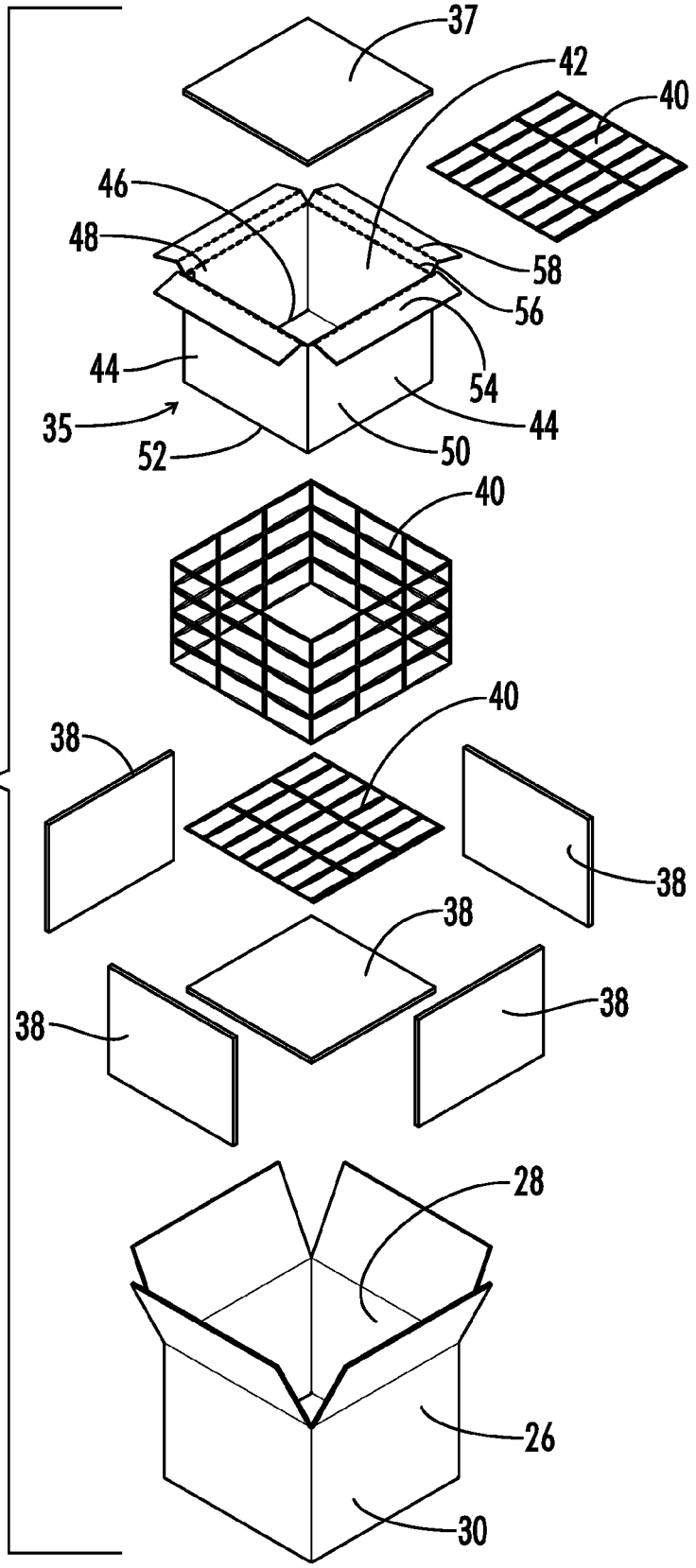
FIG. 1 illustrates an isometric, exploded view of first, second, third and fourth insulating materials for use in a box system of one embodiment of the present invention; the first and fourth insulating materials are corrugated cardboard, the second insulating material is expanded polystyrene and the third insulating material is a water jacket.

The present invention relates to a box system for keeping medicine and other payloads at a desired temperature for prolonged periods of time. The system generally includes three or more insulating materials between a refrigerant and the payload so that the payload is not cold-shocked by the refrigerant but, instead, maintains a desired temperature range during shipment. An advantage of the box system of certain embodiments of the present disclosure is that the system allows a shipper to use a temperature controlled system that is effective in controlling temperature without the need for any expensive phase change materials. Without being bound to any particular theory, it is believed that creating a system in which several different types of insulating materials are located between the refrigerant and the payload delays the transfer of thermal energy between the refrigerant and the payload, and, thus allows for temperature, controlled conditions without the use of expensive phase change materials. It is believed that the first, second, and third insulating materials achieve a ballasting effect.

Referring now to the drawings, FIGS. 1-15 illustrate a temperature controlled box system generally designated by the numeral 10. In the drawings, not all reference numbers are included in each drawing for the sake of clarity.

Figure 8:
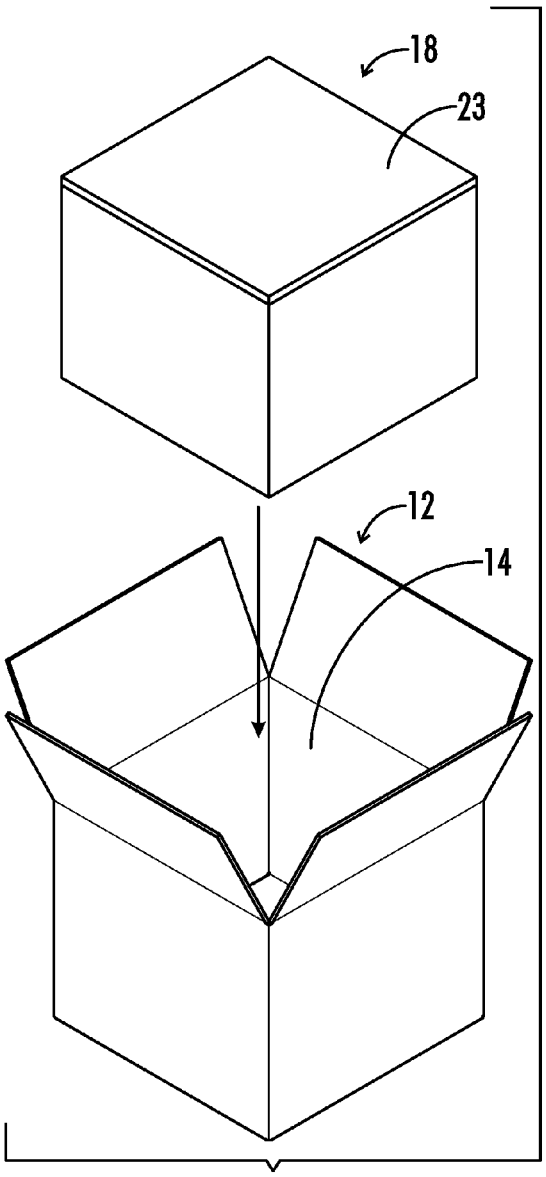
FIG. 8 illustrates an isometric, exploded view of a first outer box being placed in a second outer box.
Figure 9:
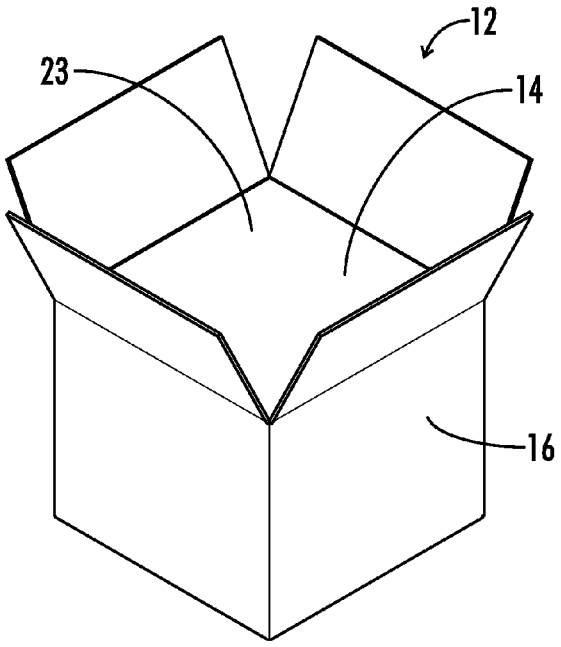
FIG. 9 illustrates an isometric view of a second outer box; the top of the second outer box is open.
Figure 10:
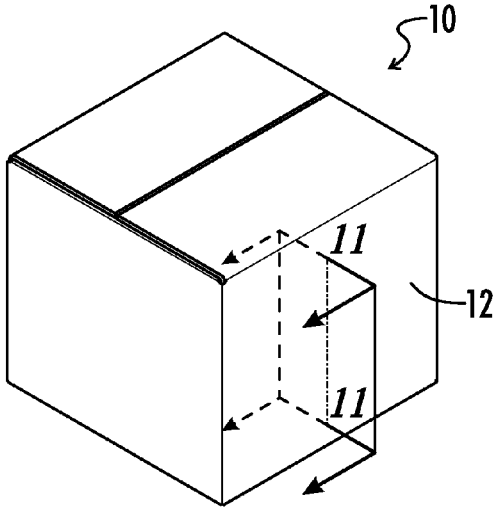
FIG. 10 illustrates an isometric view of the second outer box of FIG. 9 with its top closed.
Figure 11:
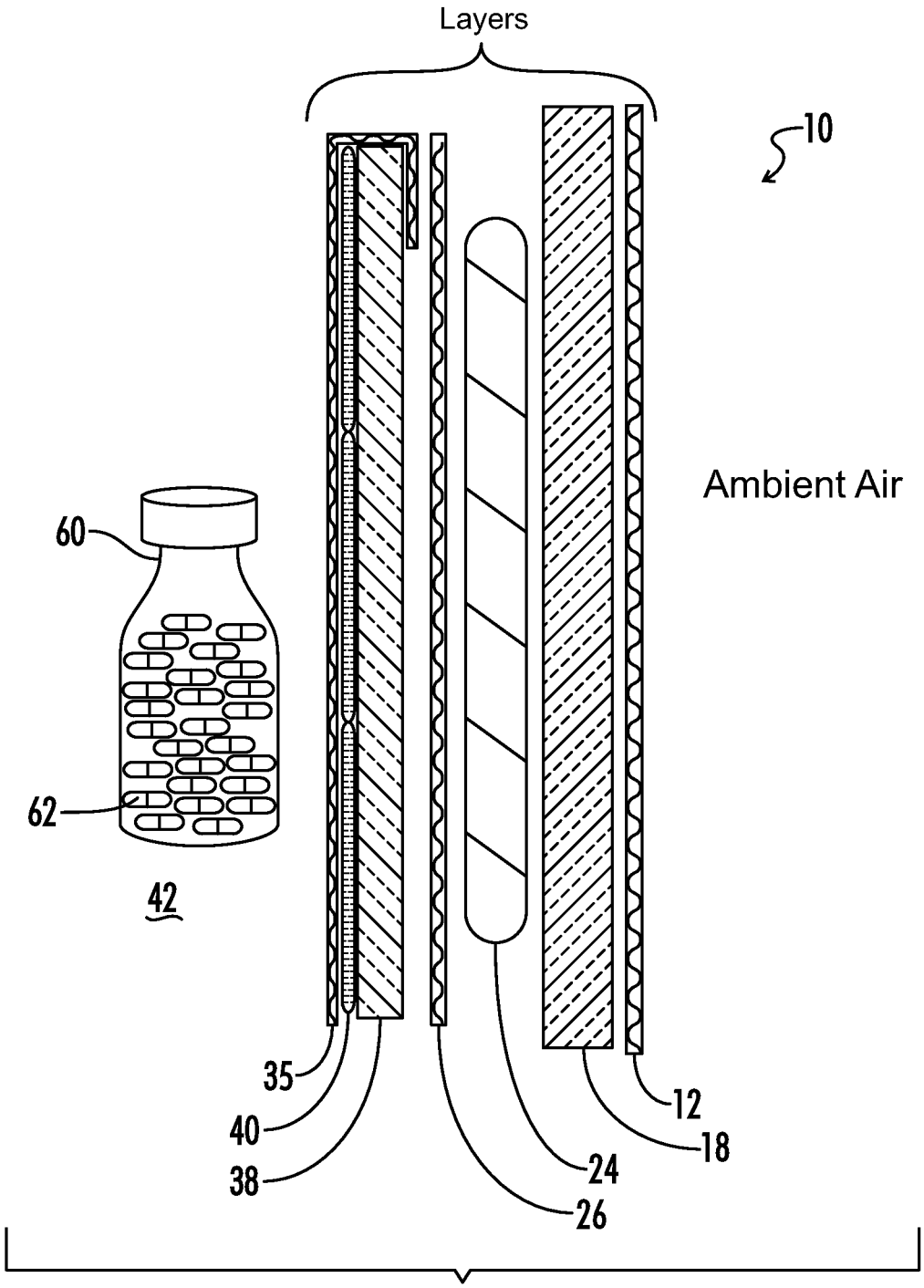
FIG. 11 is a representational diagram showing the insulating materials between the refrigerant and the payload container taken from plane 11-11 in FIG. 10.

Referring further to FIGS. 1-15, the box system 10 includes a first outer box 18 having an exterior 22 and an interior 20. One or more refrigerants 24, preferably several refrigerants, are disposed in the first outer box interior 20. In some embodiments, the refrigerants 24 are a plurality of frozen and/or refrigerated water-based gel packs. In some embodiments, the first outer box 18 is comprised of expanded polystyrene and the walls of the outer box 18 are about 1-2 inches in thickness. Preferably, the first outer box 12 has a lid 23, as shown in FIGS. 8-9. In some embodiments, the system 10 further includes a second outer box 12 that has an interior 14 and an exterior 16 and the first outer box 18 is disposed in the second outer box interior 14, as shown in FIGS. 8-11. In some embodiments, the second outer box 12 is comprised of corrugated cardboard.

The box system 10 further includes a payload 62 that is disposed interior to the refrigerant 24. The payload 62 may be any item that is desired to be kept within a certain temperature range. In some embodiments, the payload 62 is a medicine, food or an electronic device. The payload 62 may be in any form, including without limitation, solid or liquid form. Optionally, the payload 62 is disposed within a container 60. If the payload 62 is an electronic device, one or more of the components adjacent to the payload container 60, such as the lid 37 described below, may have anti-static properties. Preferably, the payload 62 is a medicine and the container 60 is a plastic pill bottle or a syringe.

A first insulating material 26 is disposed between the refrigerant 24 and the payload 62 and forms a first barrier between the refrigerant 24 and the payload 62. In some embodiments, the first insulating material 26 is provided in the form of a four-sided corrugated cardboard box, as shown in FIGS. 1-7, has an exterior 30, an interior 28, four sides 29, a closed bottom 32 and a top closeable by tabs 36. In addition to corrugated cardboard, the first insulating material 26 may be, for example, liquid water, polyurethane, polyethylene, expanded polyethylene, expanded polypropylene, polypropylene, expanded polystyrene, extruded polystyrene, and corrugated plastic. As used herein, "liquid water" means $H_2O$ and does not include deuterium oxide.

Figure 2:
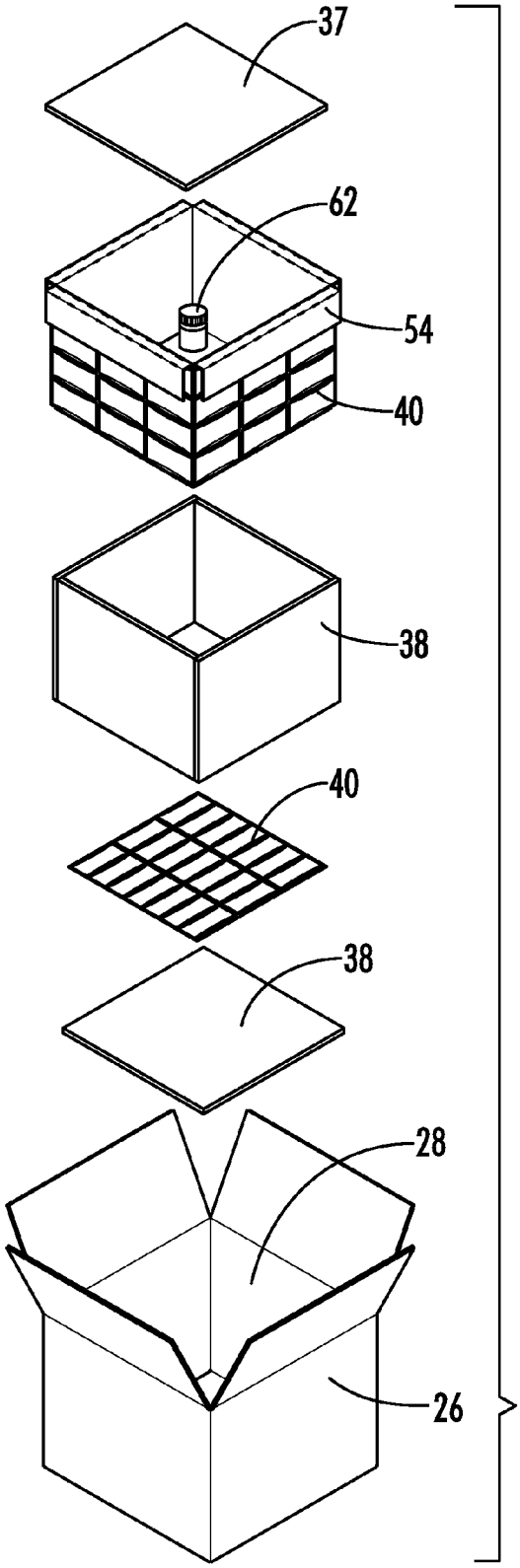
FIG. 2 illustrates an isometric, exploded view of first, second, third and fourth insulating materials for use in a box system of one embodiment of the present invention; the first and fourth insulating materials are corrugated cardboard, the second insulating material is expanded polystyrene and the third insulating material is a water jacket.

A second insulating material 38 is disposed between the first insulating material 26 and the payload 62 and forms a second barrier between the between the refrigerant 24 and the payload 62. Optionally, the second insulating material 38 substantially lines the first barrier, as best seen in FIG. 2, which shows the second insulating material 38 being loaded into the first insulating material 26. By substantially lining, it is meant that at least 75% of the surface area of a material is lined with another material. Usually, the second insulating material 38 is different than the first insulating material 26, because the difference of materials is believed to delay the transfer of thermal energy through the first and second insulating materials 26 and 38. In some embodiments, the second insulating material 38 is expanded polystyrene. In addition to expanded polystyrene, the second insulating material 38 may be, for example, corrugated cardboard, liquid water, polyurethane, polyethylene, expanded polyethylene, expanded polypropylene, polypropylene, extruded polystyrene, and corrugated plastic.

Figure 3:
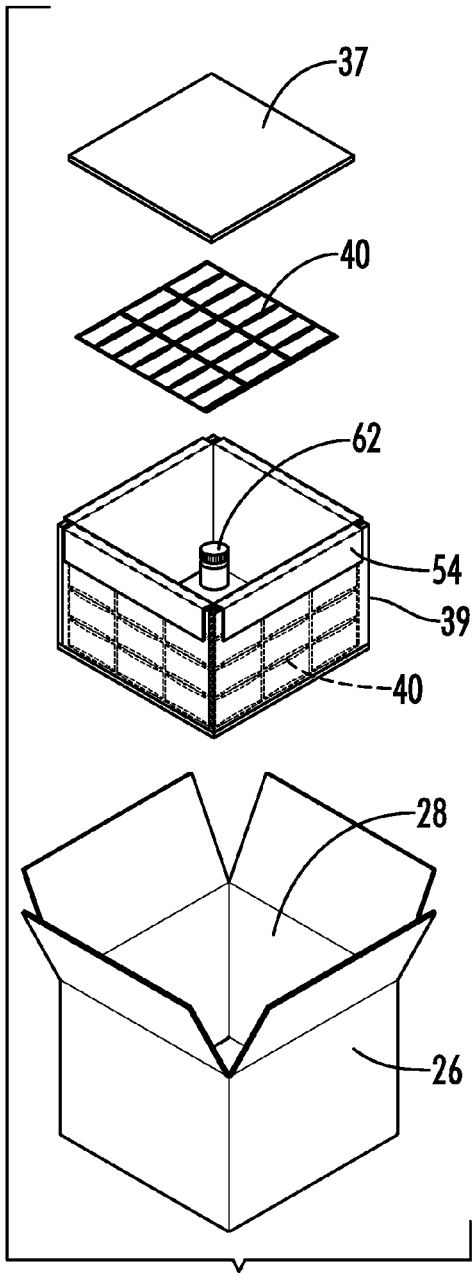
FIG. 3 illustrates an isometric, exploded view of first, second, third and fourth insulating materials for use in a box system of one embodiment of the present invention; the first and fourth insulating materials are corrugated cardboard, the second insulating material is expanded polystyrene and the third insulating material is a water jacket.

A third insulating material 40 is disposed between the second insulating material 38 and the payload 62 and forms a third barrier between the between the refrigerant 24 and the payload 62. Optionally, the third insulating material 40 substantially lines the second barrier, as best seen in FIG. 3, which shows the third insulating material 40 surrounded by the second insulating material 38. Usually, the third insulating material 40 is different than the second insulating material 38, because, again, it is believed that the difference in materials delays the transfer of thermal energy through the second and third insulating materials 38 and 40. However, the third and first insulating materials 40 and 26 may be the same. In some embodiments, the third insulating material 40 is a water jacket (i.e., interconnected cells of liquid water), as shown in FIGS. 1-4. It has been observed that a water jacket having water at room temperature is a particularly good insulant for use with the present invention. If used, the water jacket is generally well above the freezing point of water (e.g., at least about 10 degrees Celsius and preferably about 22 degrees Celsius) so that the water jacket does not cold shock the payload 62. In addition to liquid water, the third insulating material 40 may be, for example, expanded polystyrene, corrugated cardboard, polyurethane, polyethylene, expanded polyethylene, expanded polypropylene, polypropylene, expanded polystyrene, extruded polystyrene, and corrugated plastic.

Figure 4:
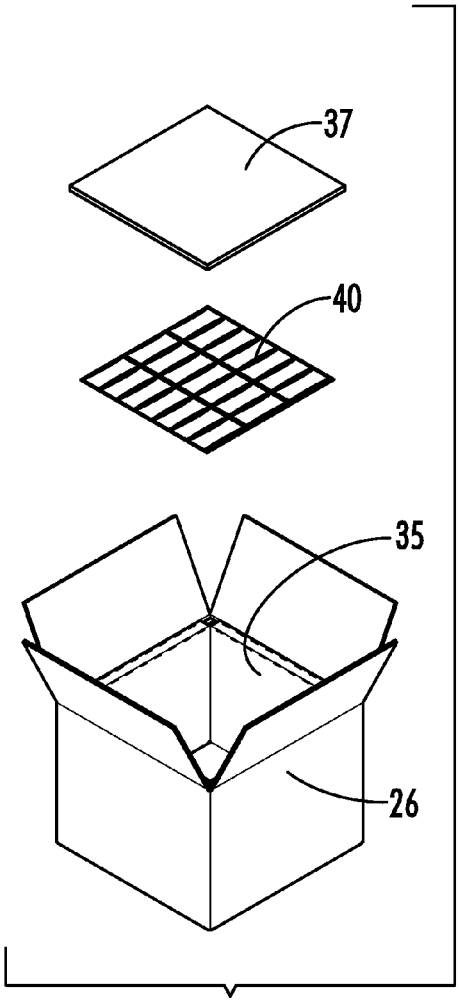
FIG. 4 illustrates an isometric exploded view of first and fourth insulating materials, which are corrugated cardboard; two lids, namely a water jacket and expanded polystyrene, are being placed on top of the fourth insulating material, specifically, on the ledges created by the tabs; second and third insulating materials, which are located between the first and fourth insulating materials, is not visible.
Figure 5:
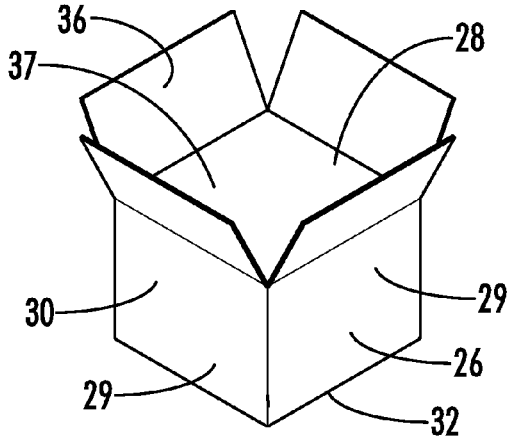
FIG. 5 illustrates an isometric view of a first insulating material, which is corrugated cardboard.
Figure 6:
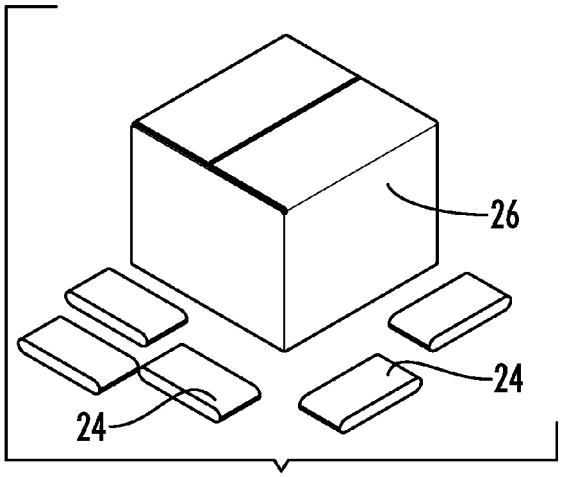
FIG. 6 illustrates an isometric view of a first insulating material, which is corrugated cardboard, and five refrigerant gels.
Figure 7:
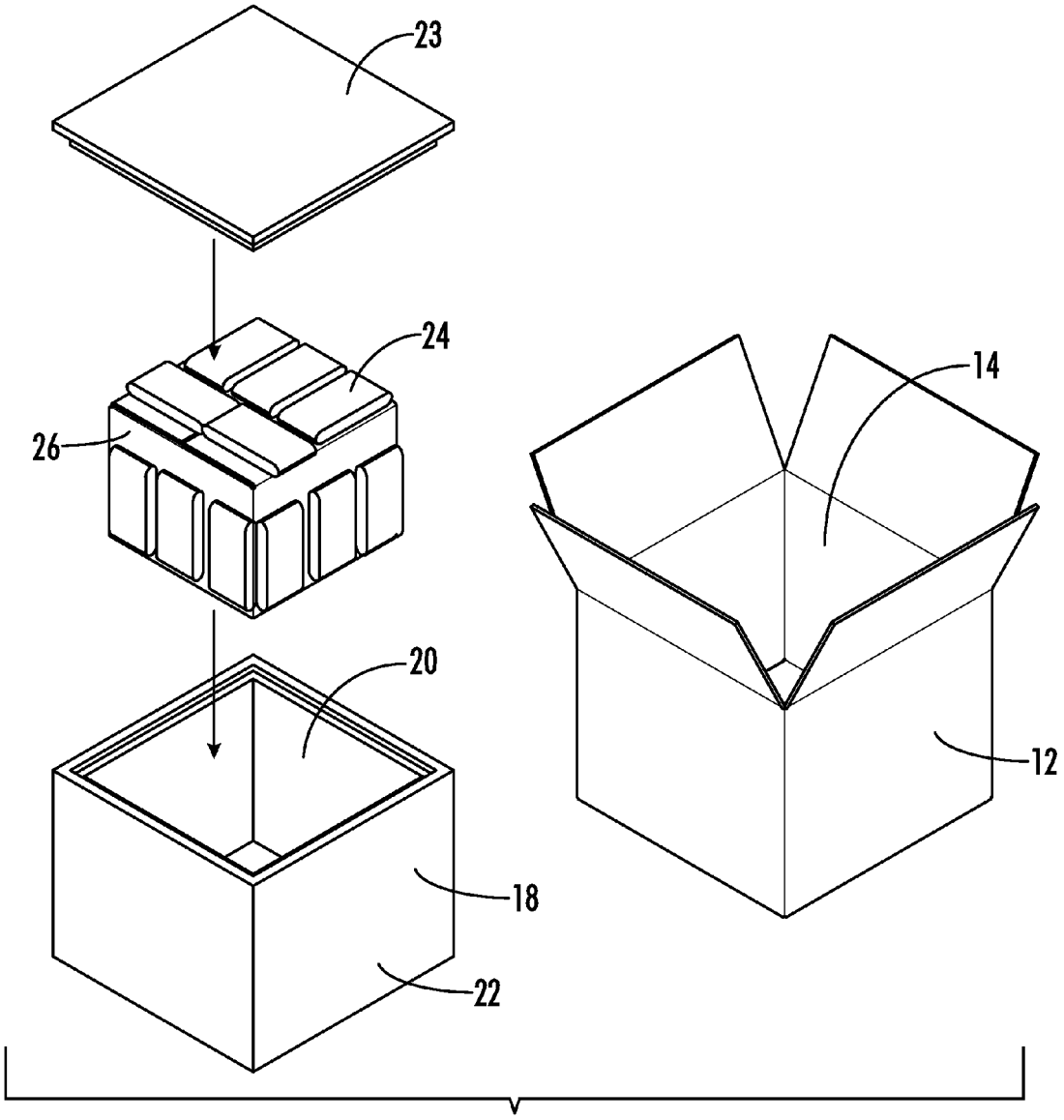
FIG. 7 illustrates an isometric, exploded view of a first insulating material, which is corrugated cardboard and is surrounded by refrigerant gels, being placed in a first outer box; a second outer box is located on the right side of FIG. 7.

Optionally, a fourth insulating material 35 is disposed between the third insulating material 40 and the payload 62 and forms a fourth barrier between the between the refrigerant 24 and the payload 62. Optionally, the fourth insulating material 35 substantially lines the third barrier, as best seen in FIG. 2, which shows the fourth insulating material 35 surrounded by the third insulating material 40. Usually, the fourth insulating material 35 is different than the third insulating material 40, because, again, it is believed that the difference in materials delays the transfer of passage of thermal energy through the third and fourth insulating materials 40 and 35. In some embodiments, the fourth insulating material 35 is provided in the form of an inner corrugated cardboard box, as shown in FIGS. 1-4, and has four sides 44, an interior 42, an exterior 50, a closed bottom 52 and an open top. The top may be closeable by an upper lid 37 comprised of an insulant. The system may include merely an upper lid 37, as shown in FIG. 2. Alternately, an insulant that is different from the insulant forming the upper lid 37 may be placed below the upper lid 37, as shown in FIGS. 3 and 4, where the third insulating material 40 is placed below the upper lid 37. Optionally, the four sides 44 each include a bottom 46, a top 48, a height extending from the top 48 of the side 44 to the bottom 46 of the side 44, and the tops 48 of the sides 44 each comprise a generally rectangular tab 54 extending therefrom. Optionally, the tabs 54 each have a first foldline/scoreline 56, located at the intersection of each tab 54 and top 48, along which the tabs 54 are configured to fold horizontally relative to said tops 48, and the tabs include a second foldline/scoreline 56 in which the tabs 54 are configured to fold vertically relative to said tops 48. Optionally, the tabs 54 are configured such that when the tabs 54 are folded horizontally along the first foldline 56 and vertically along the second foldline 58, the tabs 58 do not extend to the bottoms 46 of the sides 44. The tabs 54 generally do not provide additional insulation to the system 10 (because the tabs 54 are generally comprised of corrugated cardboard like the first layer 26 and in some embodiments do not extend to the bottoms 46 of the sides 44) but instead merely secure the insulating materials together, as best seen in FIGS. 2-3.

Optionally, the first outer box interior 14 does not have an electrically-powered temperature control device and the box system 10 is configured to retain the desired temperature range without electricity. Optionally, the box system 10 has substantially no refrigerant 24 adjacent to the payload container 60.

The illustrated Figures generally illustrate a single insulating layer that is comprised of a single material. For example, the innermost insulating layer is shown as a 4-sided cardboard box, the next innermost layer is a water-jacket that forms a 4-sided perimeter, the next innermost layer are four pieces of expanded polystyrene that form a 4-sided perimeter, and the next innermost layer is a 4-sided cardboard box. However, it will be appreciated that adjacent sides of any given layer may be comprised of different materials. However, generally at least three materials (i.e., the first, second, and third insulating materials 26, 38 and 40) are between most, if not all, refrigerants 24 and the payload container 62 and the second insulating material 38 is different than the first and third insulating materials 26 and 40. That said, it has been observed that the lid 37 is optional in some applications, such as where the payload container 60 is a syringe that, in itself, provides sufficient insulation. However, in such applications, there are usually three materials (i.e., the first, second, and third insulating materials 26, 38 and 40) forming a perimeter around the payload container 60 and the three materials provide an insulation between the side refrigerants 24 and the payload container 60. It has also been observed that in some cases, it is not desirable to place a room temperature water jacket adjacent to a container 60 that includes a low mass payload 62 (e.g., a syringe containing medicine), because the container 60 may transfer its thermal energy to the water jacket too quickly.

In some embodiments, one of the first, second, third, and fourth insulating materials 26, 38, 40 and 35 may be a coating that coats one of the other insulating materials.

In some embodiments, t the first, second, third, and fourth insulating materials 26, 38, 40 and 35 are about 0.1 to about 1.0 inches thick.

In some embodiments, one of the first, second, third, and fourth insulating materials 26, 38, 40, and 35 may have a plurality of pores and the size of the pores may be different on opposite sides of the material so that thermal energy passes through the different sides at different speeds. For example, in one embodiment, the side facing the payload container 60 may have a first pore size and the side facing the refrigerant 24 may have a smaller pore size than the first pore size so that thermal energy enters the opposite sides at different rates.

The following examples describe various embodiments of the present invention. Other embodiments within the scope of the claims herein will be apparent to one skilled in the art from consideration of the specification or practice of the invention as disclosed herein. It is intended that the specification, together with the examples, be considered to be exemplary only, with the scope and spirit of the invention being indicated by the claims which follow the examples.

Example 1

A temperature controlled shipping box system was prepared as follows. A rectangular ECT-32 (edge crush test) corrugated cardboard shipping box having a front, a rear, two sides, a closed bottom and a closeable top was provided. The shipping box had a length of 26 inches, a width of 17 inches and a height of 16.2 inches and was made of ECT-32 ⅛ inch thick corrugated cardboard. A rectangular EPS (expanded polystyrene) box having a front, a rear, two sides, a closed bottom, and a top closeable by a lid was placed inside the corrugated cardboard shipping box. The EPS box had a length of 23 inches, a width of 17 inches, a height of 13.2 inches and the expanded polystyrene forming the bottom, sides and lid was 1.5 inches thick and had 3 pcf (pounds per cubic feet) density. A first inner box (i.e., a first insulating material) was placed centrally inside the EPS box. The first inner box was made of 32 ECT ⅛ inch thick corrugated cardboard, had a front, a rear, two sides, a closed bottom, a closeable top, a length of 20.25 inches, a width of 13.5 inches, and a height of 9 inches. A first water jacket (i.e., a second insulating material) consisting of interconnected water cells and having a thickness of 0.5 inches was placed inside the first inner box and used to line the two sides and front and rear of the first inner box. A second water jacket consisting of interconnected water cells having a thickness of 0.5 inches was used to line the bottom of the first inner box. Five rectangular strips of 3 pcf expanded polystyrene (i.e., a third insulating material) having a thickness of 0.375 inches were placed interior to the first and second water jackets and used to line the water jackets. A second inner ECT-32 corrugated cardboard box (i.e., a fourth insulating material) having a front, a rear, two sides, a closed bottom, an open top, a thickness of 0.125 inches, a length of 18.75 inches, a width of 11.75 inches, and a height of 7.75 inches was placed interior to the expanded polystyrene strips and used to line the strips. The tops of the front, rear and two sides of the second inner corrugated cardboard box were scored to create four rectangular corrugated cardboard tabs. The corrugated cardboard tabs were the same width and thickness of the sides that they were attached to. The tabs each had a first foldline/scoreline, located at the intersection of the top of the section/side and the tab, along which the tab was folded horizontally relative to the top of the section/side to create a ledge and a second foldline/scoreline along which the tab was folded downward relative to the top of the section/side. The distance from the first foldline/scoreline to the second foldline/scoreline was 0.5 inches. The distance from the second foldline/scoreline to the edge of the tab was 1.5 inches. The tabs secured the first water jacket and the expanded polystyrene to the front, rear and sides of the second inner box. A third water jacket consisting of interconnected water cells was placed on the ledge. All of the packaging materials were stabilized at 23° C. for 24 hours.

Figure 12:
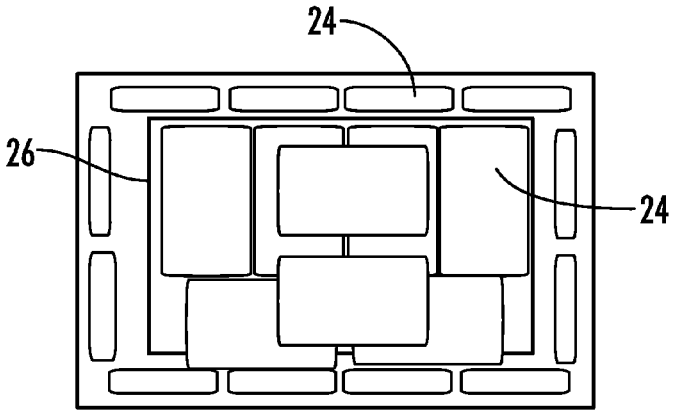
FIG. 12 is a top, plan view of the packout of EXAMPLE 1; the first insulating material and the refrigerant are shown.
Figure 13:
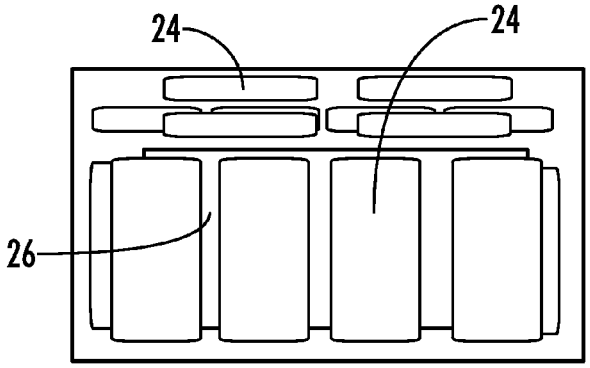
FIG. 13 is a side, elevation view of the packout of EXAMPLE 1; the first insulating material and the refrigerant are shown.
Figure 14:
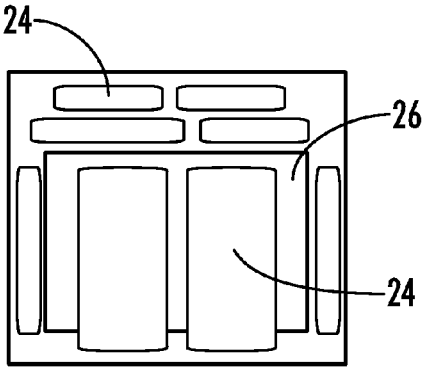
FIG. 14 is a front, elevation view of the packout of EXAMPLE 1; the first insulating material and the refrigerant are shown.

Twenty CGB-1200 (Cryopak, Edison, New Jersey) 2 pound frozen gel packs conditioned at −10° C. (+/−2° C.) for 24 hours were provided. Two frozen gel packs were placed between the front of the first inner box and the front wall of the EPS box, two frozen gel packs were placed between the rear of the first inner box and the rear wall of the EPS box, four frozen gel packs were placed between each side of the first inner box and the side walls of the EPS box. Thirty-four eight-ounce plastic water bottles were then placed inside the second inner box. The water inside the plastic water bottles was used to stimulate a payload and the water bottles were stabilized at 4° C. (+/−2° C.) for 48 hours before being loaded into the second inner box. A thermocouple was placed into one of the water bottles. The spaces between the plastic water bottles and the walls of the second inner box were filled with 0.5 inch bubble wrap. The first inner box was taped closed. Six frozen gel packs were placed on top of the first inner box to create a first layer of gel packs and two additional frozen gel packs were placed on the first layer. Top, side, and front views of the packout are shown in FIGS. 12-14, wherein the refrigerants/frozen gel packs are shown as 24 and the first insulating material (i.e., the first inner box) is labeled as 26 consistent with the above numbering scheme.

Two layers of 0.5 inch bubble wrap were placed on top of the top layer of frozen gel packs. The EPS box lid was used to close the top of the EPS box. The top of the ECT-32 corrugated cardboard shipping box was closed and taped shut.

Figure 15:
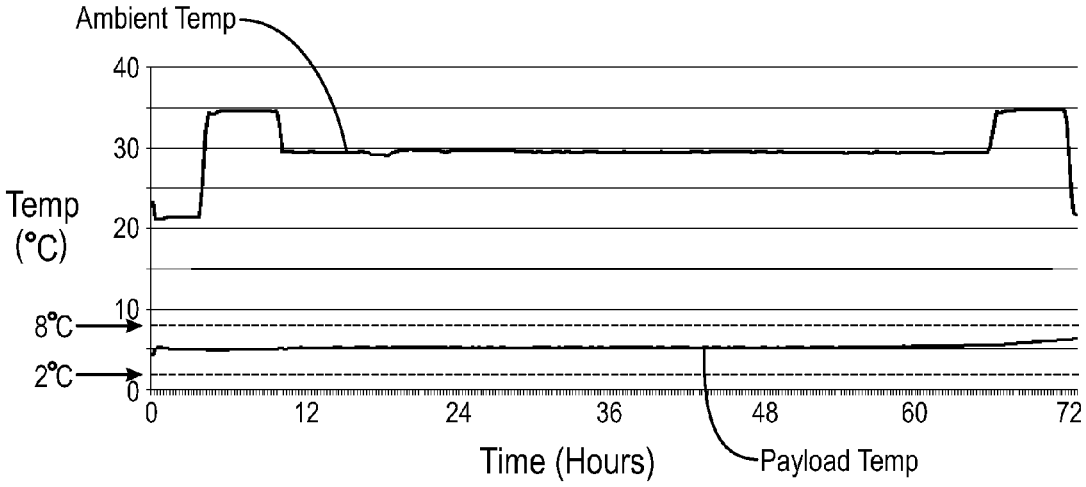
FIG. 15 is a graph showing the temperature of the payload of EXAMPLE 1 over 72 hours.

The ECT-32 corrugated cardboard shipping box was placed into an environmental chamber and subjected to Summer ISTA 7D 72-hour temperature testing (hot shipping and hot receiving) that consisted of 22° C. for four hours, 35° C. for six hours, 30° C. for 56 hours and 35° C. for 6 hours. The results of the test are provided in FIG. 15. As shown in FIG. 15, the temperature inside the water bottle remained between 2-8° C. for the 72 hour testing period.

Example 2

A temperature controlled shipping box system was prepared as follows. A rectangular ECT-32 (edge crush test) corrugated cardboard shipping box having a front, a rear, two sides, a closed bottom and a closeable top was provided. The shipping box had a length of 26 inches, a width of 17 inches and a height of 16.2 inches and was made of ECT-32 ⅛ inch thick corrugated cardboard. A rectangular EPS (expanded polystyrene) box having a front, a rear, two sides, a closed bottom, and a top closeable by a lid was placed inside the corrugated cardboard shipping box. The EPS box had a length of 23 inches, a width of 17 inches, a height of 13.2 inches and the expanded polystyrene forming the bottom, sides and lid was 1.5 inches thick and had 3 pcf (pounds per cubic feet) density. A first inner box (i.e., a first insulating material) was placed centrally inside the EPS box. The first inner box was made of 32 ECT inch ⅛ thick corrugated cardboard, had a front, a rear, two sides, a closed bottom, a closeable top, a length of 20.25 inches, a width of 13.5 inches, and a height of 9 inches. A first water jacket (i.e., a second insulating material) consisting of interconnected water cells and having a thickness of 0.5 inches was placed inside the first inner box and used to line the two sides and front and rear of the inner box. A second water jacket consisting of interconnected water cells and having a thickness of 0.5 inches was placed inside the first inner box and used to line the bottom of the inner box. A second inner ECT-32 corrugated cardboard box (i.e., a third insulating material) having a front, a rear, two sides, a closed bottom, an open top, a thickness of 0.125 inches, a length of 18.75 inches, a width of 11.75 inches, and a height of 7.75 inches was placed interior to the first and second water jackets and used to line the water jackets. The tops of the front, rear and two sides of the second inner corrugated cardboard box were scored to create four rectangular corrugated cardboard tabs. The corrugated cardboard tabs had the same dimensions and foldlines/scorelines as described in EXAMPLE 1. The tabs secured the water jacket to the front, rear and sides of the second inner box. All of the packaging materials were stabilized at 23° C. for 24 hours.

Figure 16:
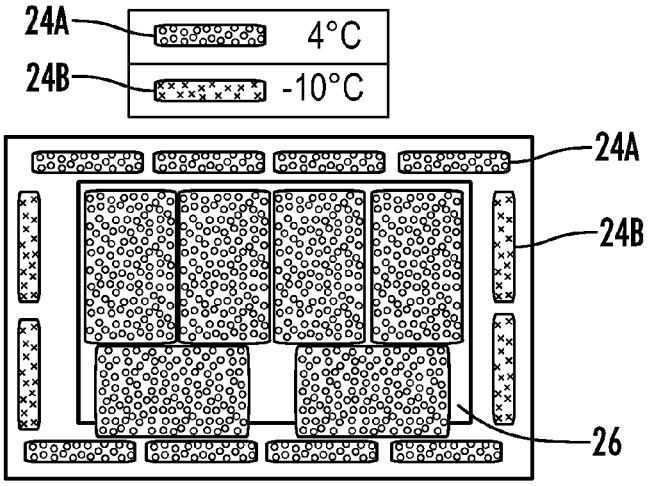
FIG. 16 is a top, plan view of the packout of EXAMPLES 2 and 3; the first insulating material and the refrigerant are shown.
Figure 17:
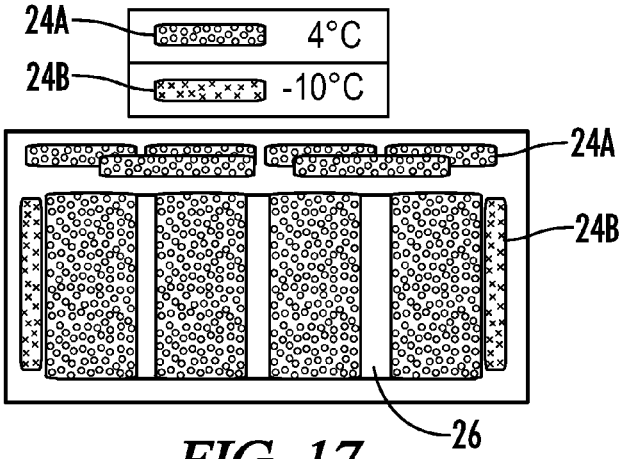
FIG. 17 is a side, elevation view of the packout of EXAMPLES 2 and 3; the first insulating material and the refrigerant are shown.
Figure 18:
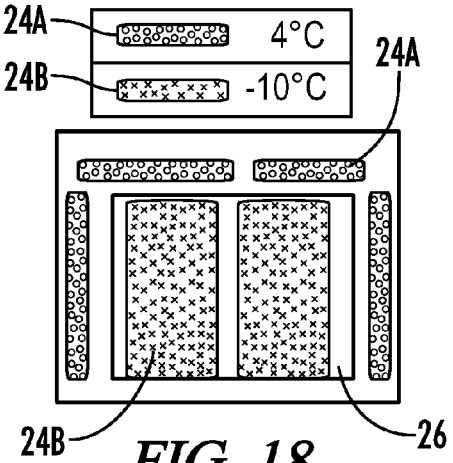
FIG. 18 is a front, elevation view of the packout of EXAMPLES 2 and 3; the first insulating material and the refrigerant are shown.

Four CGB-1200 (Cryopak, Edison, N.J.) 2 pound frozen gel packs conditioned at −10° C. (+/−2° C.) for 24 hours and fourteen CGB-1200 (Cryopak, Edison, N.J.) 2 pound refrigerated gel packs conditioned at 4° C. (+/−2° C.) for 24 hours were provided. Two frozen gel packs were placed between the front of the first inner box and the front wall of the EPS box and two frozen gel packs were placed between the rear of the first inner box and the rear wall of the EPS box. Four frozen gel packs were placed between each side of the first inner box and the side walls of the EPS box. Five eight ounce bottles of water was then placed inside the second inner box. The water bottles were stabilized at 4° C. (+/−2° C.) for 48 hours before being loaded into the second inner box. A thermocouple was placed into one of the water bottles. The first inner box was taped closed. Six refrigerated gel packs were placed on top of the first inner box. Top, side, and front views of the packout are shown in FIGS. 16-18, wherein the refrigerated gel packs are shown as 24A, the frozen gel packs are shown as 24B and the first insulating material (i.e., the first inner box) is labeled as 26.

1 inch of bubble was placed on top of the top frozen gels. The EPS box lid was used to close the top of the EPS box.

Figure 19:
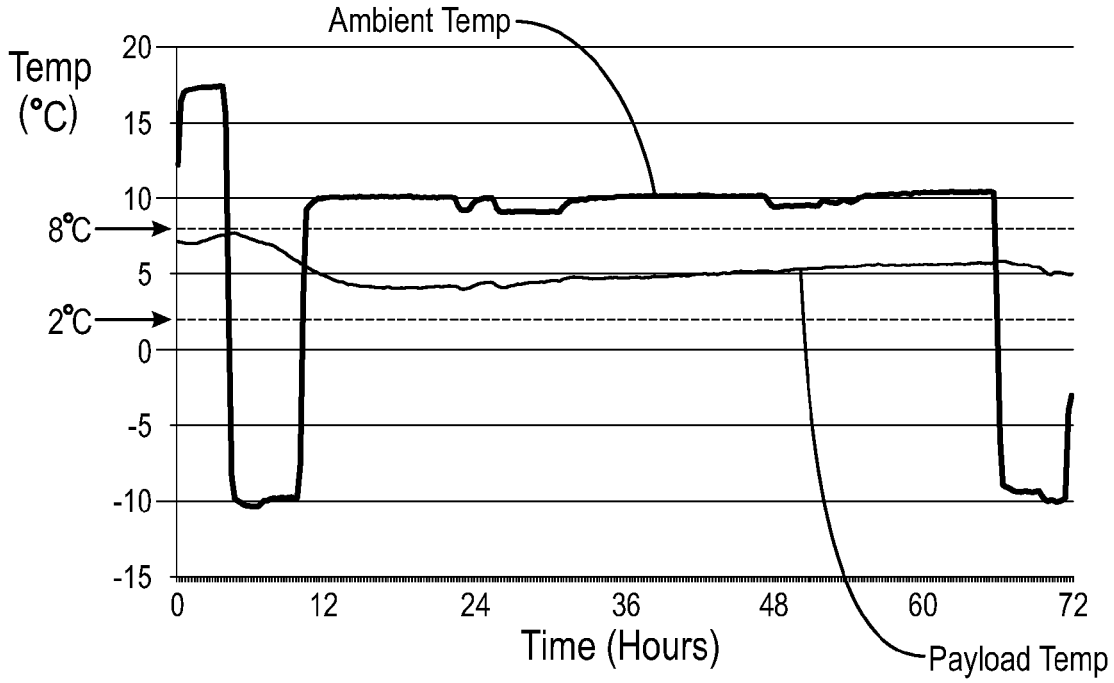
FIG. 19 is a graph showing the temperature of the payload of EXAMPLE 2 over 72 hours.

The ECT-32 corrugated cardboard shipping box was placed into an environmental chamber and subjected to Winter ISTA 7D 72-hour temperature testing that consisted of 18° C. for four hours, −10° C. for six hours, 10° C. for 56 hours and −10° C. for 6 hours. The results of the test are provided in FIG. 19. As shown in FIG. 19, the temperature inside the water bottle remained between 2-8° C. for the 72 hour testing period.

Example 3

Figure 20:
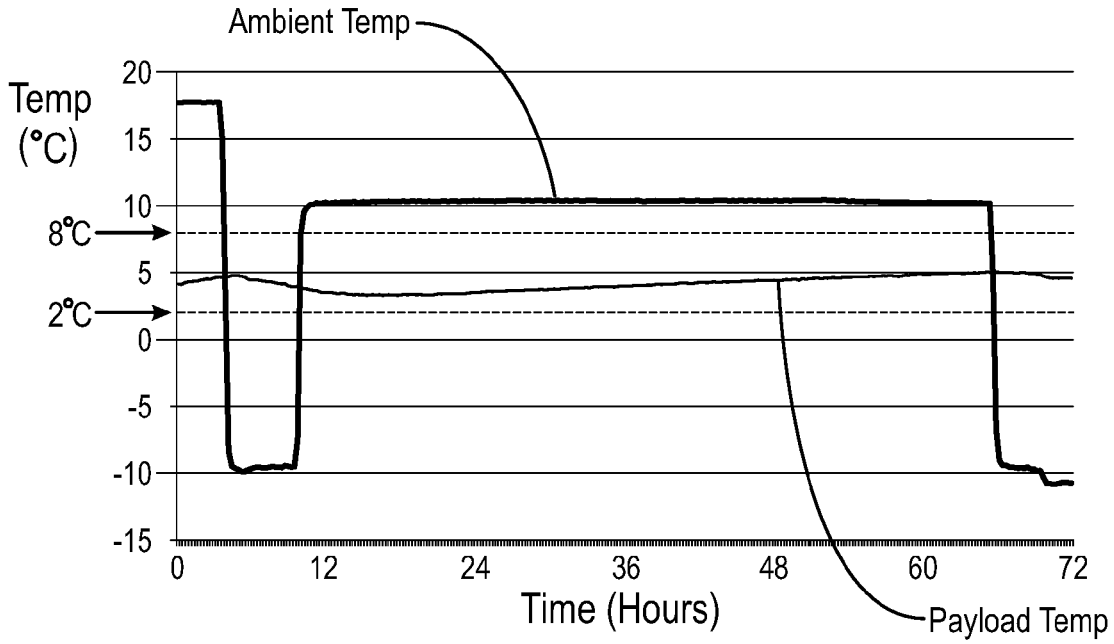
FIG. 20 is a graph showing the temperature of the payload of EXAMPLE 3 over 72 hours.

A third temperature controlled shipping box system identical to EXAMPLE 2 except that the payload was thirty-four eight ounce bottles of water was prepared and subjected to Winter ISTA 7D 72-hour temperature testing as described in EXAMPLE 2 directly above. As shown in FIG. 20, the temperature inside the water bottle remained between 2-8° C. for the 72 hour testing period.

Comparative Example 1

A control box was prepared identical to the system of EXAMPLE 1 above except that the control box did not contain a water jacket (i.e., a second insulating material) or rectangular strips of 3 pound expanded polystyrene (i.e., a third insulating material) and the control box only contained five water bottles. To mimic the thickness of the water jacket and expanded polystyrene strips along the two sides and front and rear, corrugated cardboard was placed between the two sides and front and rear of the first and second inner boxes.

Figure 21:
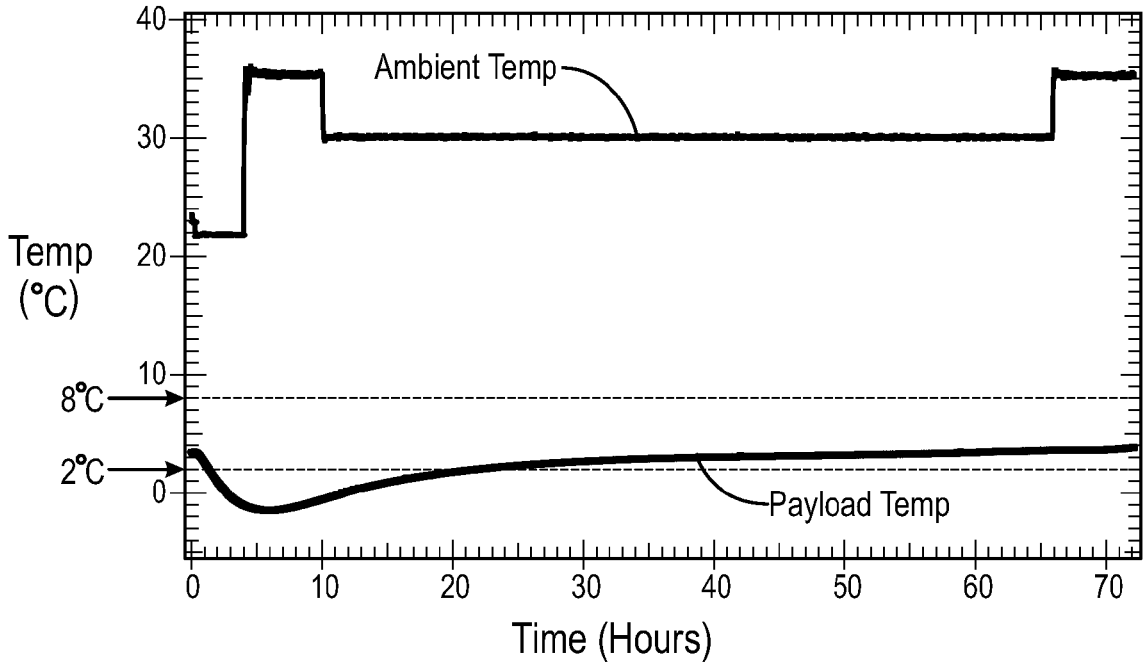
FIG. 21 is a graph showing the temperature of the payload of COMPARATIVE EXAMPLE 1 over 72 hours.

The ECT-32 corrugated cardboard shipping box of COMPARATIVE EXAMPLE 1 was placed into an environmental chamber and subjected to Summer ISTA 7D 72-hour temperature testing (hot shipping and hot receiving) that consisted of 22° C. for four hours, 35° C. for six hours, 30° C. for 56 hours and 35° C. for 6 hours. The initial temperature reading of the thermocouple inside the water bottle was 3.2° C. Less than 2 hours into the testing, the temperature inside the water bottle dropped to 1.7° C. and 3 hours into the testing, the temperature inside the water bottle dropped to 0.3° C. The results of the test are provided in FIG. 21.

The following conclusions can be drawn from EXAMPLE 1 and COMPARATIVE EXAMPLE 1: Without the insulant system of the present disclosure, the payload will be subject to cold shock by ice packs.

What is claimed is:

1. A container system comprising:

a) a first outer container having an exterior, an interior, a bottom, at least one side extending upwardly from the bottom, and a lid opposite said first outer container bottom, said first outer container comprised of an insulating material other than cardboard;

b) at least one refrigerant container comprising a water-based refrigerant having a refrigerant temperature, said at least one refrigerant container spaced about disposed in said first outer container interior;

c) a payload container comprising an interior and an exterior, said payload container disposed interior to said at least one refrigerant container within said first outer container interior;

d) a payload having a temperature of between about 2 degrees and about 8 degrees Celsius disposed in said payload container interior;

e) a first insulating material disposed between said at least one refrigerant container and said payload container, wherein said first insulating material is an insulant other than water;

f) a second insulating material disposed between said first insulating material and said payload container; and g) a third insulating material disposed between said second insulating material and said payload container, wherein said second insulating material is different from said first insulating material and said third insulating material;

wherein one of said second insulating material and said third insulating material comprises at least one liquid water container comprising liquid water having a temperature higher than the refrigerant temperature, said liquid water having a temperature of at least about 10 degrees Celsius, further wherein said container system is configured to maintain said payload at a temperature of between about 2 degrees and about 8 degrees Celsius for at least about 72 hours when the container system is subjected to 22° C. for the first four hours, 35° C. for the next six hours, 30° C. for the next 56 hours and 35° C. for the last six hours.

2. The container system of claim 1, wherein the system further comprises a fourth insulating material disposed between said third insulating material and said payload container, wherein said fourth insulating material is different from said third insulating material, and further wherein said first, second, third and fourth insulating materials are at about room temperature and said payload is a medicine.

3. The container system of claim 1, wherein said first, second and third insulating materials are at about room temperature and said payload container is a plurality of containers comprising a medicinal payload and each of said plurality of containers is interior to said third insulating material.

4. The container system of claim 1, wherein said first and said third insulating materials are corrugated cardboard and said second insulating material is said at least one liquid water container.

5. The container system of claim 1, wherein said refrigerant has a temperature of no more than 0 degrees Celsius.

6. The container system of claim 1, wherein said container system further comprises a second outer container, said second outer container having an interior and an exterior, and further wherein the first outer container is located in said second outer container interior and further wherein said second outer container is a cardboard box.

7. The container system of claim 1, wherein said first outer container interior does not have an electrically-powered temperature control device.

8. A container system comprising:

a) a first outer container having an exterior, an interior, a bottom, at least one side extending upwardly from the bottom, and a lid opposite said first outer container bottom, said first outer container comprised of an insulating material other than cardboard;

b) at least one refrigerant container comprising a water-based refrigerant spaced about said first outer container interior, said water-based refrigerant having a refrigerant temperature;

c) a payload container comprising an interior and an exterior, said payload container disposed interior to said at least one refrigerant container within said first outer container interior;

d) a payload disposed in said payload container interior;

e) a first layer comprising a first insulating material, said first layer spaced about a perimeter of said payload container, said first insulating material at about room temperature;

f) a second layer comprising a second insulating material, said second layer located between said first insulating material and said at least one refrigerant container, said second insulating material at about room temperature; and g) a third layer comprising a third insulating material, said third layer located between said second insulating material and said at least one refrigerant container, said third insulating material at about room temperature, wherein said third insulating material is an insulant other than water, wherein said second insulating material is different from said first insulating material and said third insulating material and further wherein one of said first insulating material and said second insulating material comprises at least one liquid water container comprising liquid water having a temperature higher than the refrigerant temperature, said liquid water having a temperature of about room temperature.

9. The container system of claim 8, wherein substantially all of the water contained within the first outer container interior and exterior to the second insulating material is at a temperature of no more than about 0° C. and said container system is configured to maintain said payload at a temperature of at least about 1 degrees Celsius for at least about 24 hours when the container system is subjected to 22° C. for the first four hours, 35° C. for the next six hours, and 30° C. for the next 14 hours.

10. The container system of claim 8 wherein said second layer substantially lines said first layer and said third layer substantially lines said second layer.

11. The container system of claim 8 further comprising:

a fourth layer comprising a fourth insulating material located between said third insulating material and said at least one refrigerant container, said fourth insulating material at about room temperature, wherein said fourth insulating material is different from said third insulating material and said fourth insulating material is an insulant other than water.

12. The container system of claim 8, wherein said first outer container interior contains no more than about 0.25 pounds of a phase change material having a melting point between about 2 degrees Celsius and about 8 degrees Celsius.

13. The container system of claim 8, wherein said payload is a medicine.

14. The container system of claim 8, wherein said container system is configured to maintain said payload at a temperature of between about 2 degrees and about 8 degrees Celsius for at least about 120 hours.

15. The container system of claim 8, wherein said container system further comprises a second outer container, said second outer container having an interior and an exterior, and further wherein the first outer container is located in said second outer container interior and further wherein said second outer container is a cardboard box.

16. The container system of claim 1 wherein said first insulating material is comprised of cardboard and forms a box, said box generally rectangular in shape and comprising an open top, a bottom, and four sides, each side having a top, a bottom, and a height extending from the top of the side to the bottom of the side, wherein said tops of said sides each comprise a tab extending therefrom, said tabs having a first foldline, located at the intersection of each tab and each top, in which said tabs are configured to fold horizontally relative to said tops, and a second foldline in which said tabs are configured to fold vertically relative to said tops.

17. The container system of claim 16, wherein said tabs secure said second insulating material and said third insulating material to said box.

18. The container system of claim 16, wherein when said tabs are folded horizontally along said first foldline and vertically along said second foldline, said tabs do not extend to said bottoms of said sides.

19. A container system comprising:

a) a first outer container having an exterior and an interior, said first outer container comprised of an insulating material other than cardboard;

b) at least one refrigerant container comprising a water-based refrigerant spaced about said first outer container interior, said water-based refrigerant having a refrigerant temperature;

c) a payload container comprising an interior and an exterior, said payload container disposed interior to said at least one refrigerant container within said first outer container interior;

d) a medicine disposed in said payload container interior, said medicine having a temperature of between about 2 degrees Celsius and about 8 degrees Celsius;

e) a first layer comprising a first insulating material, said first layer exterior to said payload container, said first insulating material at about room temperature, wherein said first insulating material is an insulant other than water;

f) a second layer comprising a second insulating material, said second layer disposed between said first insulating material and said payload container, said second insulating material at about room temperature; and g) a third layer comprising a third insulating material, said third layer disposed between said second insulating material and said payload container, said third insulating material at about room temperature, wherein said second insulating material is different from said first insulating material and said third insulating material, and further wherein one of said second insulating material and said third insulating material comprises at least one liquid water container comprising liquid water having a temperature higher than the refrigerant temperature, said liquid water having a temperature of about room temperature.

20. The container system of claim 19 wherein said third layer is a cardboard box.

21. The container system of claim 19, wherein said third layer is spaced about a perimeter of said payload container.

22. The container system of claim 19 wherein said container system is configured to maintain said medicine at a temperature of between about 2 degrees and about 8 degrees Celsius for at least about 72 hours when the container system is subjected to 22° C. for the first four hours, 35° C. for the next six hours, 30° C. for the next 56 hours and 35° C. for the last six hours.

23. The container system of claim 19 further comprising an outer cardboard box having an exterior and an interior, said outer cardboard box interior comprising said first outer container.

24. The container system of claim 19, wherein said first outer container interior does not have an electrically-powered temperature control device.

25. The container system of claim 19, wherein said payload container is a plurality of containers comprising said medicine and each of said plurality of containers is interior to said third insulating material.

* * * * *